US005445438A

United States Patent [19]

Drumm

[11] Patent Number: 5,445,438

[45] Date of Patent: Aug. 29, 1995

[54] STRIP BRUSH FOR MOUNTING ON A ROTARY DRUM

[76] Inventor: Arthur E. Drumm, 14808 Hillview Rd., Marysville, Ohio 43040

[21] Appl. No.: 300,842

[22] Filed: Sep. 6, 1994

Related U.S. Application Data

[60] Continuation-in-part of Ser. No. 167,083, Dec. 16, 1993, Pat. No. 5,358,312, which is a continuation-in-part of Ser. No. 132,099, Oct. 5, 1993, Pat. No. 5,358,311, which is a division of Ser. No. 958,799, Oct. 9, 1992, Pat. No. 5,251,355, which is a continuation-in-part of Ser. No. 777,905, Oct. 17, 1991, Pat. No. 5,160,187.

[51] Int. Cl.[6] ..... A46D 3/00

[52] U.S. Cl. ..... 300/21; 15/183

[58] Field of Search ..... 300/21; 15/179, 182, 15/183, 199, 193, 204

[56] References Cited

U.S. PATENT DOCUMENTS

| | | | |
|---|---|---|---|
| 1,492,806 | 5/1924 | Meyer . | |
| 2,136,103 | 11/1938 | Herold | 300/21 |
| 2,303,386 | 12/1942 | Peterson | 300/21 X |
| 2,511,004 | 6/1950 | Peterson | 300/21 X |
| 2,757,400 | 8/1956 | Peterson | 300/21 X |
| 2,767,418 | 10/1956 | Lombardi | 15/183 |
| 2,778,047 | 1/1957 | Nielsen | 300/21 X |
| 2,778,048 | 1/1957 | Nielsen | 300/21 X |
| 2,921,329 | 1/1960 | Peterson | 15/183 X |
| 2,978,726 | 4/1961 | Park | 15/183 |
| 3,002,212 | 10/1961 | Tilgner | 300/21 X |
| 3,228,053 | 1/1966 | Horton et al. | 15/199 X |
| 3,241,172 | 3/1966 | Tilgner . | |
| 3,649,984 | 3/1972 | Kershaw et al. | 15/179 |
| 3,715,773 | 2/1973 | Drumm | 15/183 |
| 3,862,462 | 4/1975 | Reiter . | |
| 3,942,210 | 3/1976 | Clark | 15/179 |
| 4,133,147 | 1/1979 | Swift, Jr. | 300/21 X |
| 4,142,267 | 3/1979 | Clark . | |
| 4,485,514 | 12/1984 | Droeser | 15/199 X |
| 4,490,877 | 1/1985 | Drumm . | |
| 4,493,170 | 1/1985 | Hanger | 451/463 |
| 4,498,210 | 2/1985 | Drumm . | |
| 4,955,102 | 9/1990 | Cousins | 15/183 X |
| 5,045,091 | 9/1991 | Abrahamson et al. . | |
| 5,160,187 | 11/1992 | Drumm . | |
| 5,358,312 | 10/1994 | Drumm | 300/21 |

FOREIGN PATENT DOCUMENTS

| | | | |
|---|---|---|---|
| 82431 | 11/1956 | Denmark | 15/183 |
| 1093323 | 11/1960 | Germany | 15/183 |
| 2218914 | 10/1973 | Germany | 15/183 |
| 2707673 | 8/1978 | Germany | 15/183 |
| 710230 | 6/1954 | United Kingdom | 300/21 |
| 779845 | 7/1957 | United Kingdom | 300/21 |
| 780225 | 7/1957 | United Kingdom | 300/21 |
| 790826 | 2/1958 | United Kingdom | 15/183 |

*Primary Examiner*—Frances Han
*Attorney, Agent, or Firm*—Sidney W. Millard

[57] ABSTRACT

A bristle strip for rotary brushes comprising a supporting channel in which the closed ends of U-shaped bristles are clamped. The channel is provided with laterally-extending guide members mounted directly thereon that project laterally outwardly beyond its side flanges to guide the strip when it is inserted in a guide track on a rotary drum and to retain it therein.

11 Claims, 5 Drawing Sheets

FIG. 1
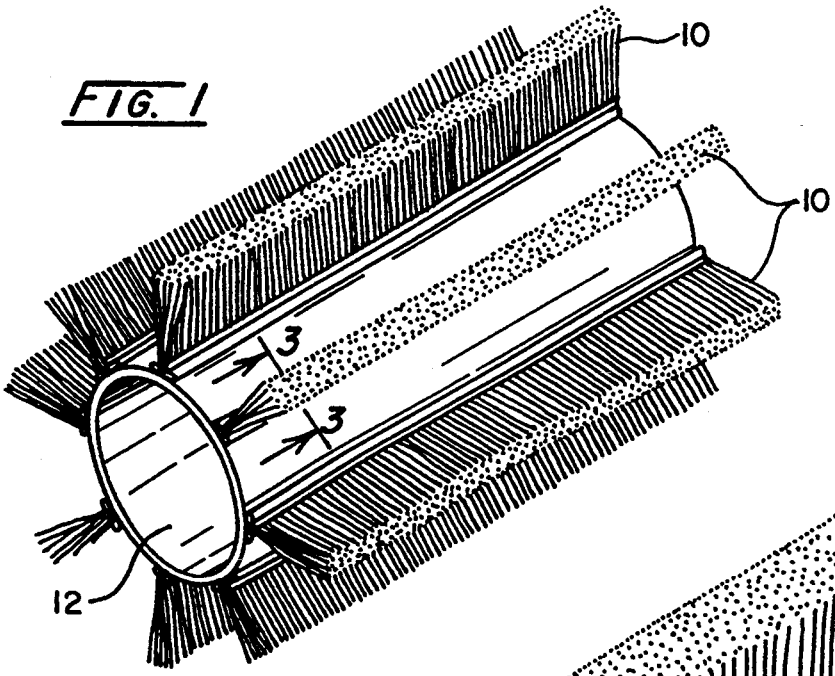
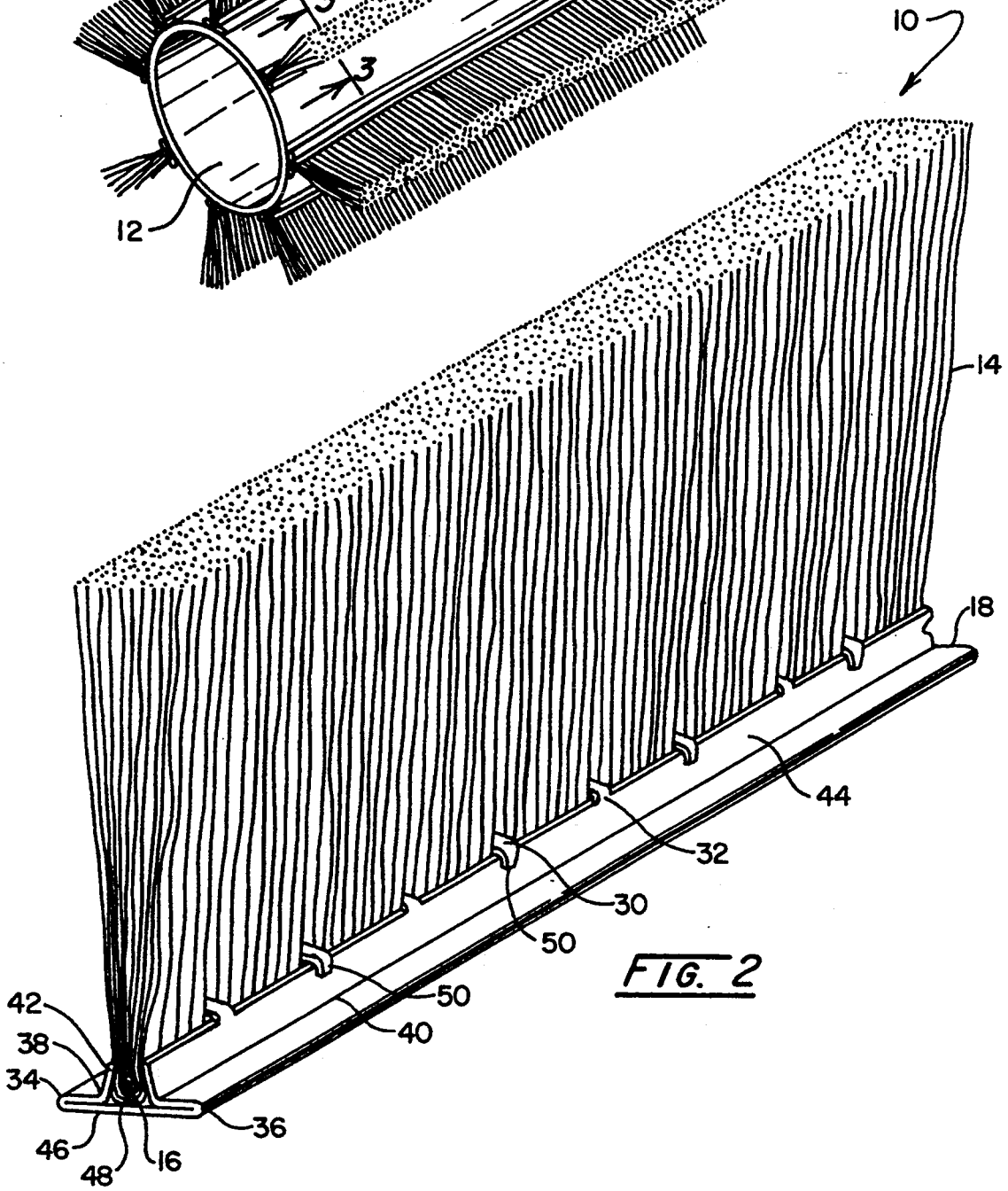
FIG. 2

STRIP BRUSH FOR MOUNTING ON A ROTARY DRUM

This is a continuation-in-part of application Ser. No. 08/167,083, filed Dec. 16, 1993, now U.S. Pat. No. 5,358,312, which is a continuation-in-part of application Ser. No. 08/132,099, filed Oct. 5, 1993, now U.S. Pat. No. 5,358,311, which is a divisional of application Ser. No. 07/958,799, filed Oct. 9, 1992, now U.S. Pat. No. 5,251,355, which is a continuation-in-part of application Ser. No. 07/777,905, filed Oct. 17, 1991, now U.S. Pat. No. 5,160,187.

FIELD OF THE INVENTION

This invention relates to rotary brushes of the type comprising a rotary drum with strips of bristles mounted on its periphery. The strips are mounted in tracks on the drum and can be removed for replacement when worn.

BACKGROUND OF THE INVENTION

Rotary brushes now commonly on the market and in use consist of a drum which carries bristle strips on its periphery. The strips are mounted in various ways on the drum and are usually removable so that they can be replaced after wear. It is important that the strip be of such a nature that it can be produced with simple tooling and at a low cost of time and material.

A present method of making a rotary sweeper includes forming a strip for sliding into a track secured on the drum periphery by double-joining, back-forming, etc. to provide an outwardly-opening, bristle-receiving channel with laterally-extending lower flanges adapted to slip in the laterally-extending grooves of the drum-mounted tracks. This method requires expensive tooling and produces a weak retaining arrangement that results in a leverage problem during rotation of the drum tending to cause the flanges of the outwardly-opening bristle-receiving channel to spring apart and thereby release the bristles.

This invention provides a thermoplastic strip which can slip into any guide track that provides laterally-opposed receiving guide grooves which extend longitudinally of the track. Thermoplastic guide strips are known but, the bristles of the known strips are secured in the trough of the supporting strip as strands welded or secured in place by plastic melt, not as a U-shaped bristle strip with a central wire or cord holding the bristles in place.

The present invention further provides a strip brush for mounting on a rotary drum which is of simple construction and can be removably slipped into tracks of the type now conventionally provided on rotary drums. This bristle strip can be produced without high-cost materials, expensive tooling or time-consuming operations. This results in a low-cost strip. It can be inserted readily into the drum track, will be effectively retained therein and can be removed with ease when it is necessary to replace it. The bristle strip is lighter weight, easier to install and remove as compared to prior art strips and is less costly to produce.

SUMMARY OF THE INVENTION

The bristle strip of this invention is of channel form and receives a mat of bristles of U-form having a retaining wire or cord running through the closed end of the U-shape with the open end of the bristles in position to sweep debris from a surface as in the prior art. This mat of bristles is retained in the carrying channel by mechanically securing the sides or flanges of the channel together or providing especially structured side flanges. The channel is provided with guide means for fitting into the drum-carried track in the form of laterally-extending guide members which project laterally outwardly beyond the upstanding flanges of the channel. These guide members slip directly into the laterally-opposed continuous receiving guide grooves of the drum-mounted track.

This invention is an advance in the art, in that, it forms the bristle holding flanges and the transversely extending guide members or ears completely from one extruded strip of thermoplastic resin.

Additionally, structure is provided to mechanically secure the mat of U-shaped bristles within the channel.

Objects of the invention not clear from the above will be fully understood upon a review of the drawings and a description of the preferred embodiment which follows.

BRIEF DESCRIPTION OF THE DRAWINGS

The best mode contemplated in carrying out this invention is illustrated in the accompanying drawings in which:

FIG. 1 is a perspective view of a drum having a plurality of bristle strips mounted thereon in straight parallel angularly spaced relationship;

FIG. 2 is an enlarged perspective view of a single bristle strip of one form of this invention;

DETAILED DESCRIPTION OF THE PREFERRED EMBODIMENT

Figure 3:
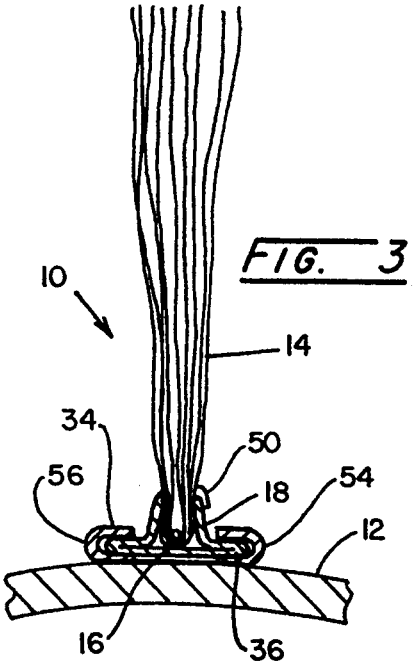
FIG. 3 is a transverse sectional view taken along line 3—3 of FIG. 1 having one type of drum track into which the bristle strip of this invention is slipped.

With reference to FIGS. 1 and 2, a plurality of bristle strips 10 are mounted on the periphery of a rotary drum 12. Drum 12 is conventionally mounted on a large vehicle (not shown) designed specifically to rotate the drum to sweep snow, debris and the like from a surface transversed by the vehicle. An example is a street sweeper.

Each bristle strip includes a bristle mat 14 deformed into a generally U-shape during the manufacturing process. An elongated wire or cord of metal, plastic or fiber 16 extends the full length of the bristle mat at the inner part of the U-shaped loop for holding the bristle mat uniformly in place in a deformed metal strip 18. The deformed metal strip 18, bristle mat 14 and cord 16 comprise the preferred embodiment of the invention which are combined in unique fashion and then mounted in conventional slide elements mechanically secured to the periphery of the rotary drum 12.

Figure 6:
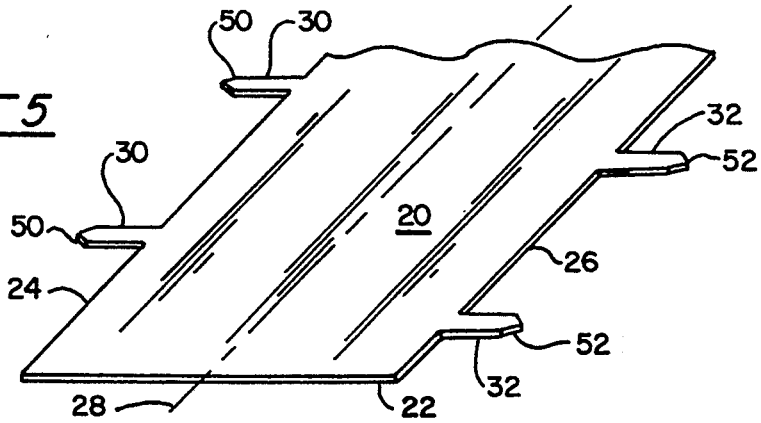
FIG. 6 is a fragmentary perspective view of a metal strip used in making the bristle strip of this invention.

The deformed metal strip 18 is initially a flat metal strip 20 as illustrated in FIG. 6 having a near end 22, side edges 24 and 26, and a centerline 28.

Projecting transversely from each side edge 24, 26 are a plurality of prongs 30, 32, which project from each side edge in co-planer fashion with the strip 20.

Figure 7:
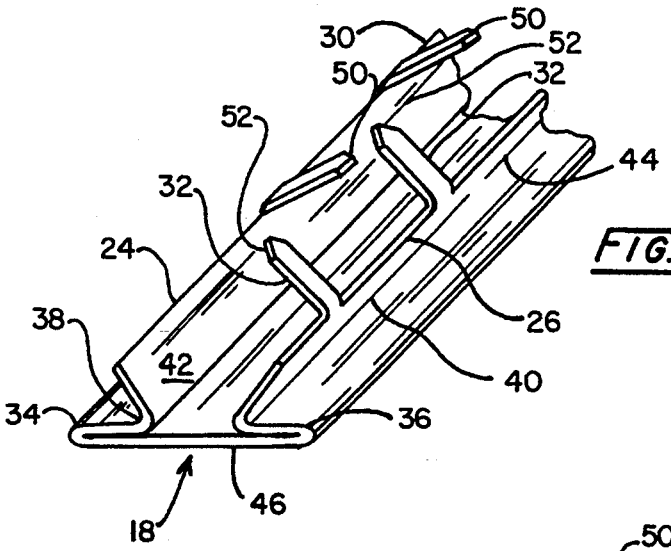
FIG. 7 is a fragmentary perspective view of the strip of FIG. 6 deformed to an intermediate shape as part of the process for forming the channel which carries the bristles.

Looking to FIG. 7, the transverse sides are folded over on themselves about 180 degrees toward the centerline 28 to form a double layer of metal strip to serve as parallel guide members or ears 34, 36. A pair of intermediate folds 38, 40 further deform the strip 20 to form a pair of upstanding flanges 42, 44.

Figure 8:
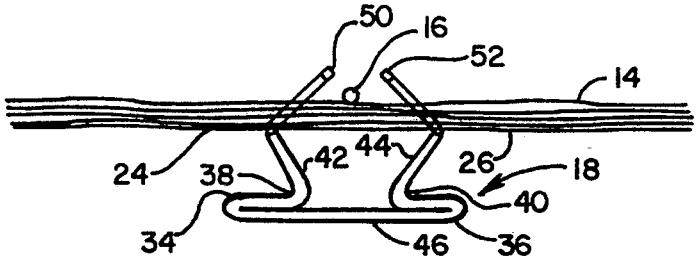
FIG. 8 is a schematic end elevational view of the intermediate shape of FIG. 7, a bristle mat and a holding wire during the manufacturing process.
Figure 9:
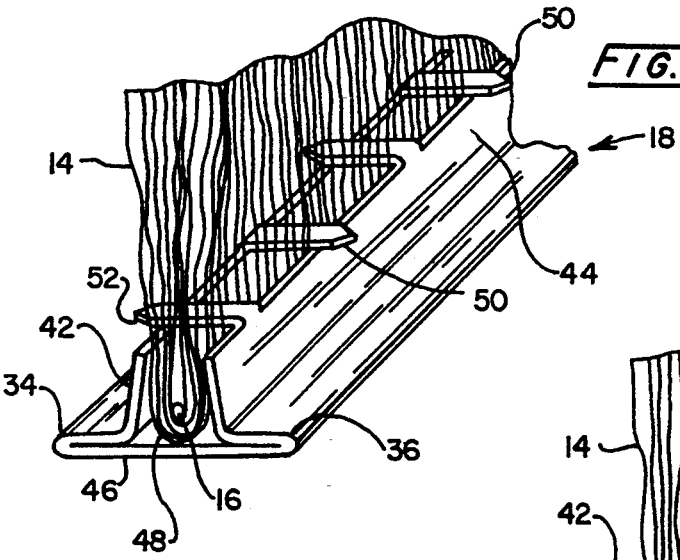
FIG. 9 is a fragmentary perspective view of the channel of FIG. 8 after it is formed from the flat strip, bristle mat and wire as a succeeding intermediate manufacturing step.
Figure 10:
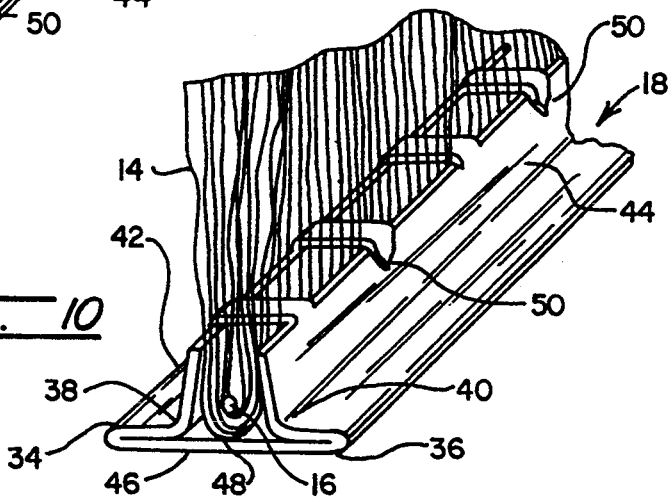
FIG. 10 is a fragmentary perspective view similar to FIG. 9 with flange retaining means deformed into operative position.

The intermediate manufacturing steps illustrated in FIGS. 7 and 8 show the flanges diverging upwardly from the flat base 46 of strip 18 and the purpose is to allow the easy insertion of the bristle mat 14 which is deformed and pushed into place by the elongated cord 16 illustrated best in FIG. 8. After the cord 16 and bristle mat 14 are pushed downwardly such that the closed lower end or bottom 48 of the U of the bristle mat 14 is in engagement with the flat base 46, flanges 42, 44 are crimped inwardly in an arc toward the centerline 28 such that they converge in an upward direction away from flat base 46. The cord 16 is located below the upper extension of flanges 42, 44. This inward crimping serves to hold the bristle mat 14 within the channel or trough formed by the deformed metal strip 18. To further secure the flanges 42, 44 in this relatively stationary position, the tip ends 50, 52 of tabs 30, 32 are crimped over to provide a mechanical engagement with the opposite flange. Thus, the flanges 42, 44 become relatively immobile and cannot easily spring open to allow the bristle strip 10 to be flipped out of operative position upon the rotation of the drum 12 adjacent some surface to be swept.

It will be observed that the tip ends 50, 52 of tabs 30, 32 are tapered at their tip ends and the purpose is to provide smooth sliding penetration through the many bristles of the bristle strip 10 without pushing the bristles out of their desired projection area.

FIG. 3 illustrates a conventional slide to receive bristle strip 10 where two facing U-shaped metal elements 54, 56 are welded or otherwise mechanically secured to the surface of a drum 12 and configured to receive the ears 34, 36 of deformed metal strip 18 to hold the bristle strip 10 in relatively stationary position on the drum 12.

Figure 4:
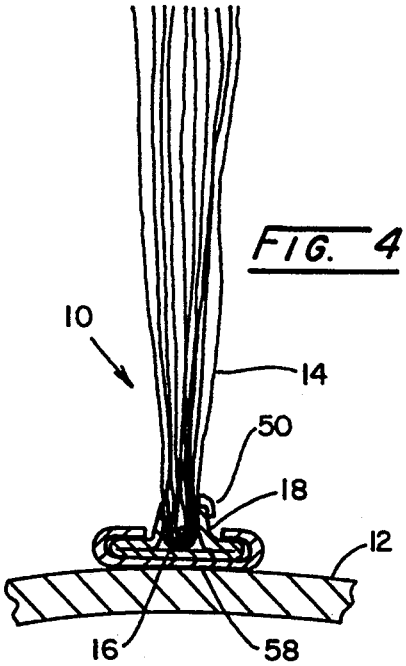
FIG. 4 is a sectional view similar to FIG. 3 showing a different form of track with the bristle strip of this invention inserted.

FIG. 4 indicates an alternative embodiment where the slide 58 is formed of a single piece rather than the two facing elements 56, 54 of FIG. 3.

Figure 5:
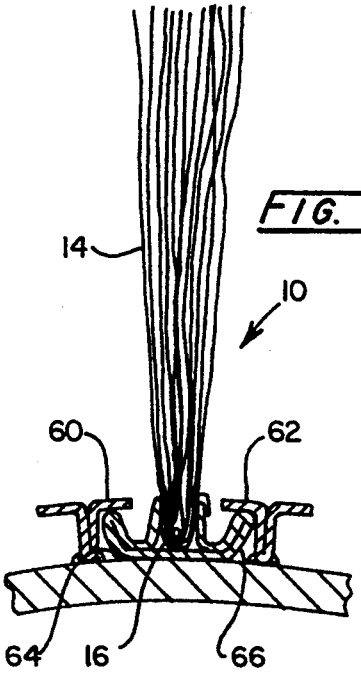
FIG. 5 is a sectional view similar to FIG. 3 showing the bristle strip slightly modified and inserted into a different form of track.

FIG. 5 illustrates-yet another embodiment where the retaining elements 60, 62 are in the form of T-shaped metal retainers and the retaining ears 64, 66 are deflected upward to fill the cavity formed by the retaining T-shaped elements 60, 62. The particular structure illustrated in FIG. 5 allows a certain amount of resilient flexing of the bristle strip 10 along its length.

Figure 11:
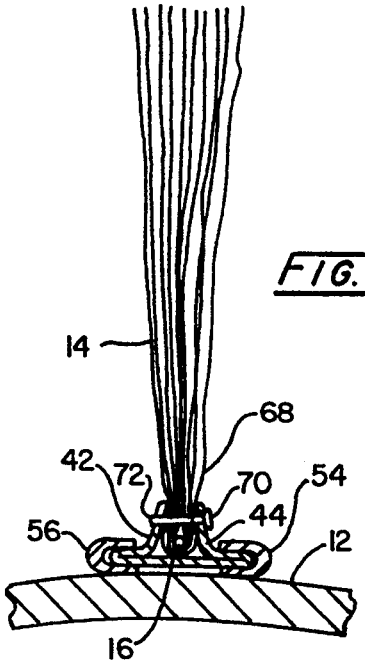
FIG. 11 is a fragmentary sectional view of a drum-mounted bristle strip similar to the bristle strip of FIG. 10 but with an alternative flange retaining means.

FIG. 11 illustrates an alternative embodiment for mechanically securing flanges 42,44 together. It substitutes a nail 68 for tabs 30,32. In the manufacturing operation, after the flanges 42, 44 are deformed into crimping position, nail 68 is driven through the flanges until its head 70 engages one flange 44. Thereafter the pointed end 72 of the nail 68 is bent over to be parallel with flange 42, and thereby, the head 70 and deformed pointed end 72 hold the flanges in operative position for the purpose described in relation to prongs or tabs 30, 32.

Figure 12:
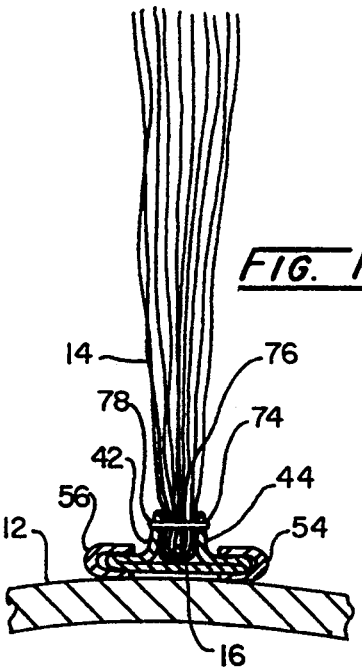
FIG. 12 is a fragmentary sectional view similar to FIG. 11 but showing another form of the flange retaining means of this invention.

FIG. 12 illustrates yet another alternative embodiment for retaining the flanges 42, 44 in place. It comprises a staple having a bridge 74 on one end and a pair of parallel prongs 76 projecting through holes in both flanges. Similar to the nail 68, the penetrating ends 78 of the staple are bent over sideways generally parallel with flange 42 to hold the flanges in place and generally converging toward the mat 14 in an upward direction from drum 12.

Figure 13:
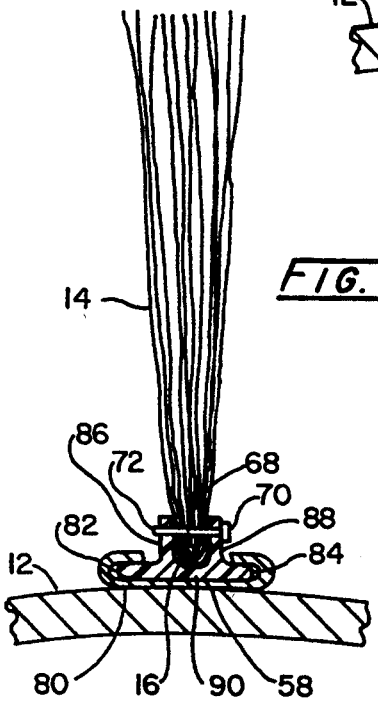
FIG. 13 is a fragmentary sectional view similar to FIG. 4 but illustrating an alternative structure of a plastic bristle-holding strip.

FIG. 13 illustrates an alternative embodiment for the strip supporting the U-shaped bristles 14 confined about cord 16. Instead of deformed metal, the strip 80 of this embodiment includes transversely extending guide members 82, 84 and upwardly extending flanges 86, 88 formed integrally with a base 90 as an extrusion of thermoplastic resin. Suitable resins are high density polypropylene, polyurethane, polyethylene, polyvinylchloride, and the like which are flexible but tough enough that nails 68 or staples 76 will not rip out during the sweeping operation.

Figure 14:
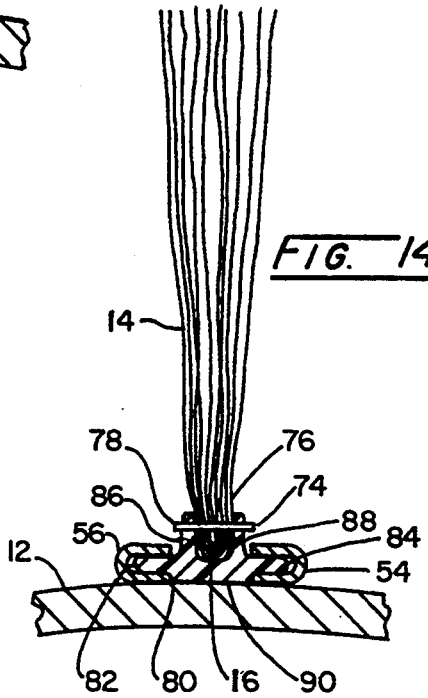
FIG. 14 is a fragmentary sectional view similar to FIG. 3 but illustrating yet another alternative structure of a plastic bristle-holding strip.

FIG. 14 illustrates another shape for resin strip 80 where ears 82, 84 are elevated from base 90 to accommodate the alternative slide which includes spaced facing elements 54, 56. In this embodiment base 90 projects downward to abut drum 12 between slide elements 54,56 to minimize bending and increase structural stability.

Figure 15:
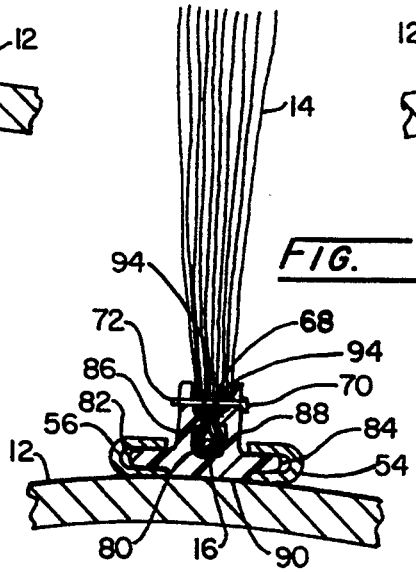
FIG. 15 is a fragmentary sectional view of yet another embodiment of a plastic bristle-holding strip.

FIG. 15 illustrates an alternative shape for strip 80 where ridges 94 project inwardly from flanges 86, 88 and above cord 16 to enhance the ability of strip 80 to hold bristles 14 in operative position.

Where extruded plastic strips 80 are used the assembly takes place in a continuous operation where the bristles 14 and wire 16 are aligned and pushed into the trough between flanges 86, 88 and nails 68 or staples 76 are applied before the strip, cord and bristles are cut to length. The resulting strip is lightweight, resilient and flexible as compared to the aforementioned deformed metal strips.

Where metal strips are cut to length, their ends are crimped or otherwise deformed to prevent bristles 14 from falling out the end and the cord 16 from moving longitudinally along the trough. That does not work with plastic strips 80 because they do not deform. To overcome their resistance to deformation or longitudinal unraveling, a sealing technique is used such as a hot cutting blade which would form a bridge across the trough as it sliced through. Alternatively, a "hog-ring" (not shown) could be crimped over each end.

Figure 16:
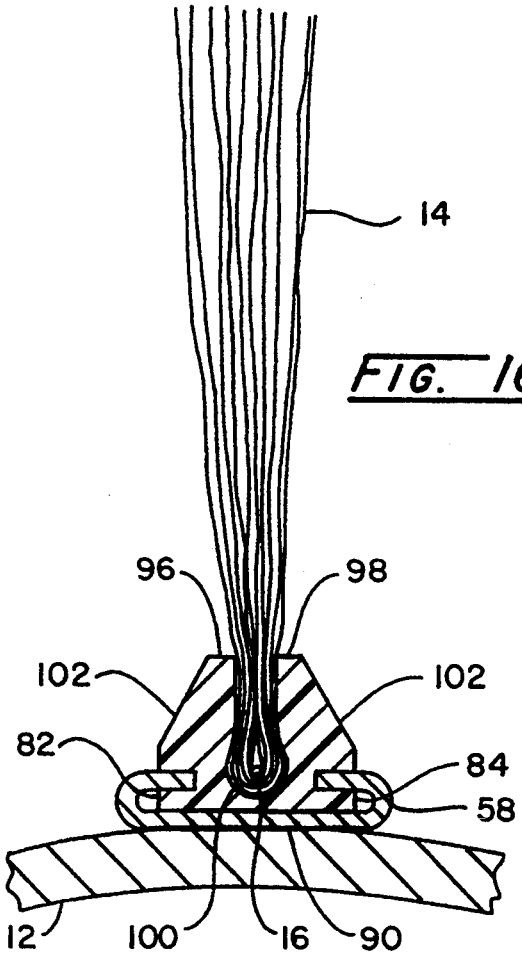
FIG. 16 is fragmentary sectional view similar to FIG. 4 but illustrating another alternative structure of a plastic bristle-holding strip.
Figure 17:
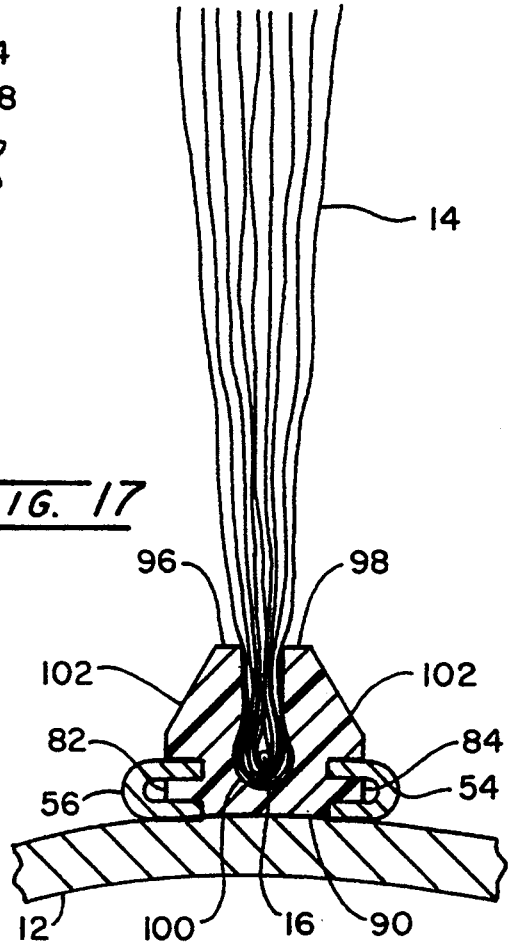
FIG. 17 is a fragmentary sectional view similar to FIG. 3 but illustrating another alternative structure of a plastic bristle-holding strip.

FIGS. 16 and 17 show alternative shapes for thermoplastic strip 80. In each case flanges 96,98 project upwardly around trough 100 to encompass the closed end 48 of bristle mat 14. Note that the trough 100 is tear shaped with a converging set of flanges 96,98 to better confine the cord 16 and bristle mat 14 in the trough. To prevent separation of flanges 96,98 during the sweeping operation each flange is beefed-up or reinforced by a transversely extending wing 102 which tapers from its outermost extension toward drum 12 until it is in close proximity to or in engagement with the upper surfaces of guide elements 54,56 or slide 58. Any tendency by a flange to deflect out of mat confining orientation is resisted by the gusset wing 102.

The only difference between the embodiments of FIGS. 16 and 17 is the difference shown between FIGS. 13 and 14. The slides 58 for FIGS. 13 and 16 are of one piece. In FIGS. 14 and 17 the guide elements 54, 56 are separate elements. In FIGS. 14 and 17 base 90 is offset downwardly from ears 82,84 to engage the surface of drum 12 between guide elements 54, 56. The gusset wings 102 which diverge toward ears 82, 84 form generally triangular shaped flanges 96,98.

As used herein the term "wire" or "cord" defining the bristle holding element 16 should be construed as including a braided cable of metal, plastic strands or natural fibers or a single metal, natural fiber or plastic strand of any geometric shape. Similarly "nails" or "staples" may be metal or plastic.

It may be appropriate to use an adhesive or hot melt technique in the plastic strips to better secure the bristle mat in the encompassing trough. Such techniques are within the inventive concept.

Having thus described the invention in its preferred embodiment, it will be clear that other modifications may be made without departing from the spirit of the invention. Also the language used to describe the inventive concept and the drawings accompanying the application to illustrate the same are not intended to be limiting on the invention. Rather it is intended that the invention be limited only by the scope of the appended claims.

I claim:

1. A bristle strip comprising an elongated continuous mat of bristles formed into a U-shape having a closed lower end and an open upper end, said mat having its lower end confined between upstanding flanges extending co-extensively with said elongated mat, said flanges terminating at upper edges, a retaining cord being clamped at a centerline within the U-shape of said elongated mat, said cord being located below the upper edges of said flanges, a bristle holding strip being formed of thermoplastic resin of a U-shape forming a trough between said flanges to enclose the lower end of the mat of bristles and including transversely extending guide and retaining ears, said flanges converging toward said mat in an upward direction away from a centerline of said elongated mat to a location above said retaining cord, means for securing said flanges in place to prevent spreading of said flanges which would allow said mat to pop out of said trough.

2. The bristle strip of claim 1 wherein said securing means comprises a nail having a head on one end, said nail projecting through holes in said flanges and with said nail head contacting one of said flanges, said nail being deformed to an L-shape with the head at one end and a transversely extending leg at the other end, said leg engaging the other of said flanges.

3. The bristle strip of claim 1 wherein said securing means comprises a deformed staple, said staple including a pair of legs joined by a bridge, said bridge abutting one of said flanges, said legs projecting through holes in said flanges, the legs having ends remote from said bridge and being deformed to abut and lie parallel with the other of said flanges.

4. The bristle strip of claim 1 wherein said strip has two ends, each end being sealed by means to prevent said bristles from moving longitudinally out of said trough.

5. The bristle strip of claim 1 including longitudinally extending ridges projecting inwardly from each flange to engage said bristles above said cord.

6. The bristle strip of claim 1 wherein said strip includes a base supporting said flanges and ears, said base being offset from said ears in a direction away from said flanges to serve as a contact support for a drum on which said strip may be mounted.

7. The bristle strip of claim 1 wherein said thermoplastic resin is selected from the group consisting of polyethylene, polypropylene, polyvinylchloride, polyurethane and mixtures thereof.

8. The bristle strip of claim 7 wherein said strip includes a base supporting said flanges and ears, said base being offset from said ears in a direction away from said flanges to serve as a contact support for a drum on which said strip may be mounted.

9. The bristle strip of claim 1 wherein said flanges are reinforced by a gusset wing at their outer surface.

10. The bristle strip of claim 9 wherein each said gusset wing diverges toward said securing means.

11. The bristle strip of claim 8 wherein said strip includes a base supporting said flanges and ears, said base being offset from said ears in a direction away from said flanges to serve as a contact support for a drum on which said strip may be mounted.

* * * * *